US005350274A

United States Patent [19]

Schmid et al.

[11] Patent Number: 5,350,274

[45] Date of Patent: Sep. 27, 1994

[54] SELF-CLEANING SIDE CHANNEL MACHINE HAVING AT LEAST ONE IMPELLER ROTATABLY MOUNTED IN THE HOUSING OF THE MACHINE

[75] Inventors: Norbert Schmid; Norbert Aust, both of Bad Neustadt, Fed. Rep. of Germany

[73] Assignee: Siemens Aktiengesellschaft, Munich, Fed. Rep. of Germany

[21] Appl. No.: 86,000

[22] Filed: Jul. 2, 1993

[30] Foreign Application Priority Data

Jul. 2, 1992 [DE] Fed. Rep. of Germany ..... 4221691

[51] Int. Cl.[5] ..... F01D 1/12

[52] U.S. Cl. ..... 415/55.1; 415/110; 415/170.1; 134/22.1; 134/22.18

[58] Field of Search ..... 415/55.1–55.7, 415/106, 110–112, 168.1, 168.2, 170.1; 134/22.1, 22.18, 42

[56] References Cited

U.S. PATENT DOCUMENTS

| | | | |
|---|---|---|---|
| 1,661,325 | 3/1928 | Derrick | 415/55.1 |
| 3,663,117 | 5/1972 | Warren | 415/106 |
| 4,194,798 | 3/1980 | Schonwald et al. | 415/55.1 |
| 5,017,086 | 5/1991 | Hansen | 415/55.1 |
| 5,137,418 | 8/1992 | Sieghartner | 415/55.1 |

FOREIGN PATENT DOCUMENTS

| | | | |
|---|---|---|---|
| 1268817 | 11/1986 | U.S.S.R. | 415/55.1 |

*Primary Examiner*—Edward K. Look
*Assistant Examiner*—Christopher Verdier
*Attorney, Agent, or Firm*—Kenyon & Kenyon

[57] ABSTRACT

A side channel machine has at least one impeller, which is rotatably mounted in the housing of the machine. The impeller includes a disk-shaped hub part and of a blade ring mounted on its periphery. The impeller can be mounted on the shaft of a drive motor by means of a hub bore provided on the hub part. In the case of this side channel machine, a side channel is formed at least on one side of the blade ring in the housing and extends circumferentially between one intake and one outlet port of the housing. Furthermore, sealing gaps are provided at least in the area of the hub part which is radially, inwardly contiguous to the blade ring between this hub part and the housing. A cleaning of the machine is rendered possible in that a supply line is provided in the area between the hub bore and the blade ring on the housing of the side channel machine. Through this supply line, a flushing fluid that will flow through the sealing gaps can be introduced into the housing. A method of cleaning the side channel machine is also described.

14 Claims, 2 Drawing Sheets

SELF-CLEANING SIDE CHANNEL MACHINE HAVING AT LEAST ONE IMPELLER ROTATABLY MOUNTED IN THE HOUSING OF THE MACHINE

BACKGROUND OF THE INVENTION

The present invention relates generally to side channel machines, and more particularly to a side channel machine having at least one impeller, which is rotatably mounted in the housing of the machine. In such machines, the impeller is comprised of a disk-shaped hub part and a hub part mounted on its periphery. The impeller can be mounted on the shaft of a drive motor by means of a hub bore provided on the hub part. With this design, a side channel is formed at least on one side of the blade ring in the housing and extends circumferentially between one intake and one outlet port of the housing. In addition, sealing gaps are usually provided at least in the area of the hub part which is radially, inwardly contiguous to the blade ring between this hub part and the housing.

Such a machine is disclosed by U.S. Pat. No. 4,992,022, which is hereby incorporated by reference. When these types of side channel machines are used in the food industry, strict hygienic requirements must be met, so the machine being used must be cleaned frequently. All surfaces which come in contact with the discharge medium, i.e., in the case of side channel compressors, all surfaces which come in contact with the delivery gas, must be treated. Problems result, in particular, with respect to the areas traversed solely by the flow of leakage gas current between the impeller and the machine housing.

The present invention is directed to the problem of developing a side channel machine of the generic type so as to allow all surfaces contacted by the discharge medium to be adequately cleaned, without having to disassemble the machine for this purpose.

SUMMARY OF THE INVENTION

The present invention solves this problem by providing a supply line in the area between the hub bore and the blade ring on the housing of the side channel machine, via which supply line a flushing fluid flowing through the sealing gaps can be introduced into the housing.

The surfaces of the hub part, which are difficult to access, and the opposing surface of the housing are able to be thoroughly cleaned by the flushing fluid that flows through the sealing gaps. The flushing fluid can be introduced under pressure into the stationary side channel machine. It flows through the side channel machine from the supply point up to the operational intake and outlet port. However, it is also possible to allow the side channel machine to operate during a cleaning operation. During operation as a vacuum pump, a partial vacuum is then generated in the vicinity of the hub part, which suffices to automatically draw in the flushing fluid. If the intake port is sealed off during the cleaning operation, then this leads to an increase in the partial vacuum in the vicinity of the hub part, thus promoting the drawing-in of the flushing fluid and its delivery through the sealing gaps. During operation as a compressor, the flushing fluid must be supplied with pressure above atmospheric pressure. The supplied flushing fluid can flow out via the opened outlet port of the side channel compressor.

One gets by with a one-sided supplying of the flushing fluid on the machine housing, when at least one perforation is provided on the hub part in the supply area of the flushing fluid. Such a perforation enables the flushing fluid to flow from one side to the other side of the hub part, so that the sealing gap situated on this other side of the hub part is also traversed by its flow.

An ample flow-through volume of flushing fluid is guaranteed when several perforations are provided and disposed with equal circumferential clearance from one another around the hub part. It has proven to be especially beneficial to shape the perforations as lengthwise slits. There are additional advantages to design the perforations to be slanted in the direction of rotation of the impeller.

When the flushing fluid is supplied in the area in the vicinity of the hub bore, the entire area of the side channel machine acted upon by the leakage gas current is covered during the cleaning operation by the flushing fluid.

DETAILED DESCRIPTION OF THE PREFERRED EMBODIMENT

Figure 1:
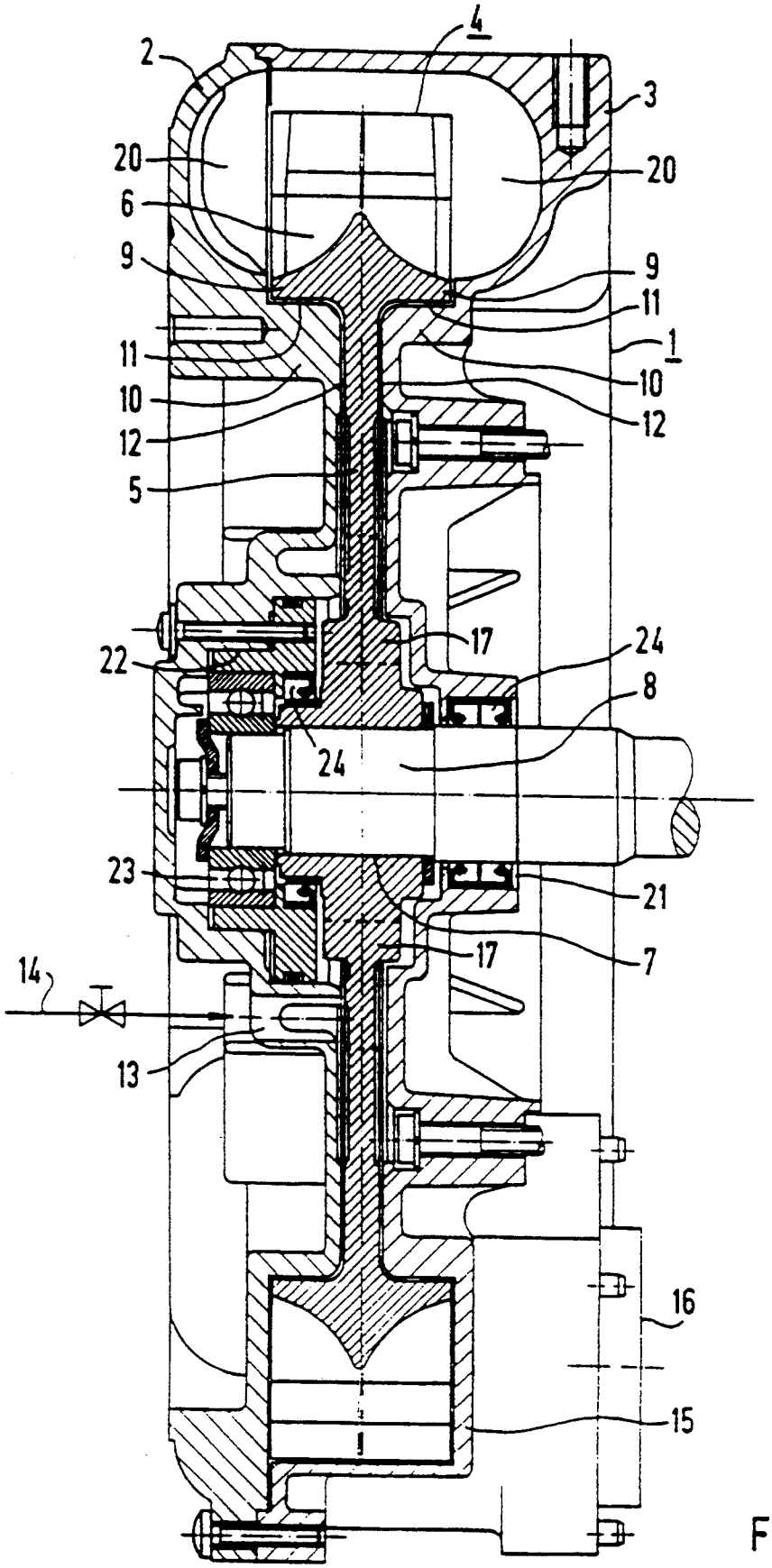
FIG. 1 depicts a side channel machine in longitudinal section.

A side channel machine, which has a housing 1, is comprised of first and second housing halves 2 and 3. An impeller 4 is rotatably mounted in this housing 1. The impeller 4 consists of a disk-shaped hub part 5 and of a blade ring 6 mounted on its periphery. The hub part 5 has a hub bore 7, which is used to slip-mount the impeller 4 on the shaft end 8 of a drive motor that is not shown in the drawing. In the illustrated exemplified embodiment, the blade ring 6 is wider than the hub part 5, so that it projects over this hub part on both sides in the direction of the axis of rotation of the impeller 4. The two housing halves 2 and 3 are designed to extend under laterally projecting sections 9 of the blade ring 6. The housing halves 2 and 3 are dimensioned with respect to the impeller 4 so as to allow a radial sealing gap 11 to form between the laterally projecting section 9 of the blade ring 6 and the part 10 of the housing halves 2 and 3 extending underneath, as well as an axial sealing gap 12 to form opposite the hub part 5. This guarantees a contact-free turning of the impeller 4 vis-à-vis the housing halves 2 and 3.

A supply port 13 is provided on the first housing half 2. A line 14 supplying a flushing fluid can be connected to this supply port 13. An interrupter 15 is situated in side channel machines between the intake and the outlet port 16.

Figure 2:
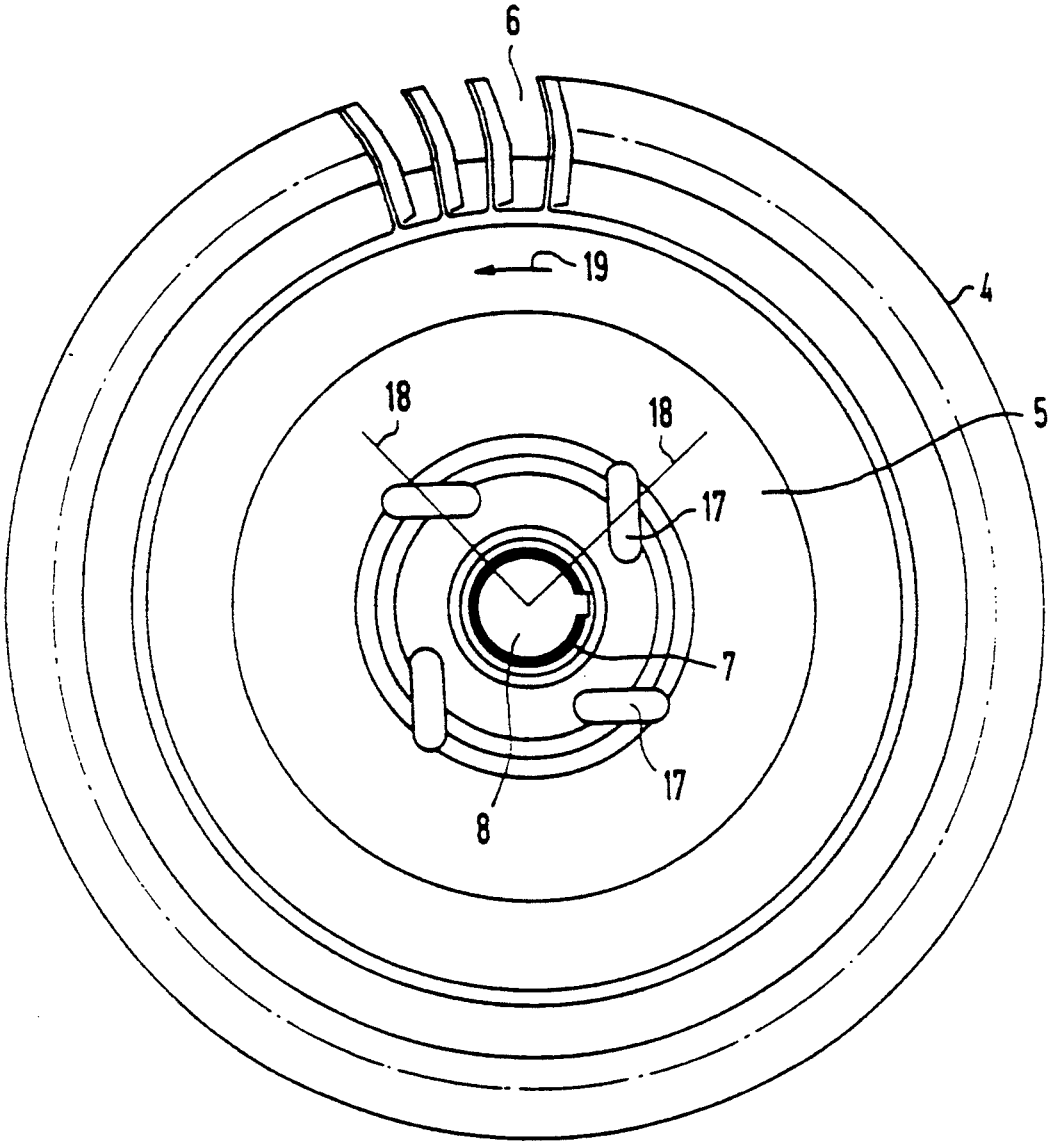
FIG. 2 shows an impeller of a side channel machine in a top view.

As the illustration of the impeller 4 in FIG. 2 shows, perforations shaped as lengthwise slits 17 are provided on the hub part 5 in the area of the hub part 5 contiguous to the hub bore 7. In relation to the radial ray 18 running through their center point, the lengthwise slits 17 are slanted to the front with reference to the direction of rotation of the impeller 4 indicated by an arrow 19. Designing the lengthwise slits 17 in this manner especially promotes the passage of the flushing fluid supplied via the supply port 13 from the one housing side to the other side of the hub part 5.

The cleaning operation can be carried out when the side channel machine is at rest or when it is running. When the side channel machine is at a standstill, the flushing fluid must be supplied with pressure via the supply line 14. The flushing fluid then flows through the axial and radial sealing gaps 12 and 11 existing at both sides of the hub part 5 and, after that, reaches the blade ring 6, and also arrives in the side channel 20 formed in each housing half 2 or 3. From there, it finally reaches the outlet port 16, or rather the inlet port (not shown in the drawing) of the side channel machine, and can flow out through these ports.

If the cleaning operation is carried out when the machine is running, then the flushing fluid can be automatically drawn in via the supply line 14 as a result of the partial vacuum prevailing inside the side channel machine. The flushing fluid is then suctioned from the supply port 13 via the axial and radial sealing gaps 12 and 11 existing on both sides of the hub part 5 between this hub part and the housing halves 2 and 3 into the working space of the side channel machine bounded by the side channels 20. When the cleaning operation is carried out in this manner, it is expedient to seal off, or rather to reduce the size of the inlet port of the side channel machine, in order to generate a higher partial vacuum in the housing 1 of the side channel machine and, thus, to improve the drawing-in and delivery of the flushing fluid. The flushing fluid then flows out of the side channel machine solely via its outlet port 16. It is especially advantageous to perform the cleaning operation when the machine is running, since this results in efficient swirling of the flushing fluid, enabling it to penetrate everywhere.

Cleaning the side channel machine with a flushing fluid requires that the shaft gland opening 21 of the second housing part 3 and the bearing bore 22 of the first housing part 2 be properly sealed off, to prevent the flushing fluid from flowing out, or rather to prevent it from flowing into the shaft bearing 23 arranged in the bearing bore 22. For this reason, suitable seals 24 are installed at the appropriate locations.

What is claimed is:

1. A self-cleaning side channel machine comprising:

a) a housing having an inlet port and an outlet port:

b) at least one impeller being arranged rotatably in the housing of the machine, wherein said impeller comprises:

(i) a disk-shaped hub part; and (ii) a blade ring being mounted on a periphery of the disk-shaped hub part; and (iii) a hub bore being disposed on the hub part, whereby said impeller is mountable on a shaft of a drive motor by means of said hub bore;

c) a side channel being formed at least one side of the blade ring in the housing and extending circumferentially between the inlet port and the outlet port of the housing;

d) a plurality of sealing gaps being disposed on both sides of the housing at least in a region of the hub part that is radially inwardly contiguous to the blade ring between said hub part and the housing;

e) a supply line being disposed in the region between the hub bore and the blade ring on the housing of the side channel machine; and f) a flushing fluid being fed via the supply line, whereby the flushing fluid flows via the sealing gaps into the side channel and from the side channel at least via the outlet port out of the side channel machine whereby said flushing fluid causes said self-cleaning.

2. The machine according to claim 1, further comprising a plurality of perforations being disposed on the hub part and guiding the flushing fluid to the other side of the hub part.

3. The machine according to claim 1, wherein the flushing fluid flows in a region of the hub part adjacent to the hub bore.

4. The machine according to claim 2, wherein the flushing fluid flows in a region of the hub part adjacent to the hub bore.

5. A self-cleaning side channel machine, comprising:

a) a housing having an intake port and an outlet port;

b) at least one impeller being rotatably mounted in the housing of the machine, and including:

(i) a disk-shaped hub part having a hub bore; and (ii) a blade ring mounted on a periphery of the disk-shaped hub part, whereby the hub part is mountable on a shaft of a drive motor;

c) a side channel being formed at least on one side of the blade ring in the housing and extending circumferentially between the intake and the outlet port of the housing;

d) sealing gaps being disposed at least in an area of the hub part that is radially, inwardly contiguous to the blade ring between this hub part and the housing;

e) a supply line being disposed in an area between the hub bore and the blade ring in the housing of the side channel machine; and f) a flushing fluid supplied into the housing via the supply port, and flowing to the side channel via the sealing gaps and flowing out of the side channel machine via the outlet port whereby said flushing fluid causes said self-cleaning.

6. The self-cleaning side channel machine according to claim 5, further comprising at least one perforation disposed on the hub part in a supply area of the flushing fluid, whereby the flushing fluid flows from one side of the blade ring to the other via the perforation.

7. The self-cleaning side channel machine according to claim 6, further comprising several perforations disposed equally spaced around the circumference of the hub part.

8. The self-cleaning side channel machine according to claim 6, further comprising a plurality of perforations that are shaped as lengthwise slits.

9. The self-cleaning side channel machine according to claim 8, wherein the lengthwise slits are slanted in a direction of rotation of the impeller.

10. The self-cleaning side channel machine according to claim 1, wherein the flushing fluid is supplied in an area of the hub part in the vicinity of the hub bore.

11. A method for cleaning a side channel machine, which machine has an impeller arranged rotatably in a housing of the machine, which impeller includes a disk-shaped hub part and a blade ring mounted on a periphery of the disk shaped hub part, and which impeller is mountable on a shaft of a drive motor by means of a hub bore provided on the hub part, said method comprising the steps of:

a) providing a side channel at least on one side of the blade ring in the housing which side channel extends circumferentially between an inlet port and an outlet port of the housing;

b) providing a plurality of sealing gaps on both sides of the blade ring at least in a region of the hub part that is radially inwardly contiguous to the blade ring between said hub part and the housing;

c) providing a supply line in a region between the hub bore and the blade ring on the housing of the side channel machine;

d) feeding a flushing fluid into the side channel machine via the supply line;

e) guiding the flushing fluid via the sealing gaps into the side channel; and f) guiding the flushing fluid from the side channel out of the side channel machine via an outlet port in the housing whereby said flushing fluid causes said self-cleaning.

12. The method according to claim 11, further comprising the step of guiding the flushing fluid to the other side of the hub part via a perforation provided on the hub part.

13. The method according to claim 11, further comprising the step of feeding the flushing fluid in the region of the hub part adjacent to the hub bore.

14. The method according to claim 12, further comprising the step of feeding the flushing fluid in the region of the hub part adjacent to the hub bore.

* * * * *